US005277305A

United States Patent [19]

Sciortino

[11] Patent Number: 5,277,305

[45] Date of Patent: Jan. 11, 1994

[54] SKI GUARD

[76] Inventor: Kenneth Sciortino, 4510 NW. 41st Ter., Lauderdale Lakes, Fla. 33319

[21] Appl. No.: 924,085

[22] Filed: Aug. 3, 1992

[51] Int. Cl.[5] ..... B65D 75/00

[52] U.S. Cl. ..... 206/315.1; 206/442; 206/523

[58] Field of Search ..... 206/83.5, 315.1, 442, 206/443, 523, 588, 589, 590, 805; 224/917

[56] References Cited

U.S. PATENT DOCUMENTS

| | | | |
|---|---|---|---|
| 3,336,961 | 8/1967 | Welsh | 206/315.1 |
| 4,172,522 | 10/1979 | Muller et al. | 206/315.1 |
| 4,191,233 | 3/1980 | McKay | 206/315.1 |
| 4,319,617 | 3/1982 | Fusaro | 206/315.1 |
| 4,380,290 | 4/1983 | Luebke | 206/315.1 |
| 4,402,355 | 9/1983 | Wymore et al. | 206/315.1 |
| 4,715,416 | 12/1987 | Horne | 206/315.1 |
| 4,746,159 | 5/1988 | Webb et al. | 224/917 |
| 5,012,921 | 5/1991 | Becker | 206/315.1 |
| 5,096,104 | 3/1992 | Wirth | 206/315.1 |
| 5,104,017 | 4/1992 | Vandagriff | 224/917 |

*Primary Examiner*—Jimmy G. Foster

*Attorney, Agent, or Firm*—Malin, Haley, DiMaggio & Crosby

[57] ABSTRACT

A ski guard constructed of high impact absorbing compressible foam shaped into a seamless tubular housing with an elongated substantially flat end plug disposed in one end of the housing. The size of the housing conforming to the shape of the ski, the resiliency of the foam providing necessary expansion for skis providing a skin tight cover to prevent internal sliding and provide an impact cushion area. A housing is placed over the tip and tail portion of the ski providing an impact cushion layer to protect the skis' edges and finish from impacts, scratches, and quick thermal expansion. A binding guard is formed by placement of foam within a fabric bag, the fabric bag fastening the binding guard about the ski bindings by use of a zipper with sealing straps. Two additional ski straps allow the skis to be carried as package in conjunction with a set of ski poles.

10 Claims, 1 Drawing Sheet

SKI GUARD

BACKGROUND OF THE INVENTION

1. Field of the Invention

This invention relates generally to snow skis and, more particularly, to a ski guard that covers and protects snow skis against impact and thermal shock.

2. Background Information

Snow skiing has evolved from rudimentary board sliding to a very technologically advanced recreational and professional sport. Each advancement in safety within the field nearly causes the existing equipment to become obsolete. For instance, evolution has displaced the use of wood skis with the latest in high technology composite materials. Contact surfaces utilize fiberglass composites that eliminate hot waxing providing a near frictionless sliding surface with the snow. The bottom of the skis are edged in steel for superior turning ability. The top of the skis are painted and/or laminated with graphics for consumer appeal. Even the bindings that attach to a skiers foot have improved so quickly that ski bindings over five years old are considered dangerous to the skier's safety.

Despite the current progression in the field, skis are far from disposable as each of the above improvements have accelerated the price of skis as quickly as the technology. For this reason many skiers may keep a set of skis longer the bindings. However, the longevity of the skis is directly dependant upon the care of the skis with most damage occurring during transportation and is the subject of numerous patents. U.S. Pat. No. 5,104,017 issued to Vandagriff discloses a ski caddy having pockets for covering of the ski ends and tips. U.S. Pat. No. 5,096,104 issued to Wirth discloses a ski carrier in the form of a two piece rigid tube. U.S. Pat. No. 5,012,921 issued to Becker provides a flexible bag that can cover and carry skis with the boots mounted thereon as well as the poles. U.S. Pat. No. 4,815,509 issued to Owen discloses a ski bag having a pleat for protecting the ski edges from touching. U.S. Pat. No. 4,792,073 issued to Jacober discloses a ski carrier for the covering and locking of bindings. U.S. Pat. No. 4,746,159 issued to Webb discloses a combination container having an individual ski compartment for placement of skis and boots. U.S. Pat. No. 4,715,416 issued to Horne discloses a two piece ski cover to encompass an individual ski including the bindings and boots fastened thereto. U.S. Pat. No. 4,191,233 issued to McKay discloses a flexible cover for each ski having a tip and tail cover and means for fastening the covers together. U.S. Pat. No. 3,948,302 issued to Kohls discloses a foldable ski cover made of flexible material designed to fold upon itself. U.S. Pat. No. 3,896,981 issued to Purple discloses a disposable one piece bag having three pockets, two of which house the skis and a third for ski poles.

All of the above prior art patents cover the skis for transportation purposes in one manner or another. The covers protect skis from salt and moisture by the use of fabric or hard covers. The benefits of a fabric cover include a low cost device that has the ability to accommodate a range of ski sizes and store in a small area when not in use, however the fabric cover provides no impact protection. Conversely, the rigid cover provides superior impact protection, but is limited in accommodating size, cannot be folded into a small storage area, and is prohibitively expensive. The ability of a hard cover to provide impact protection is extremely important as the exotic materials used in present skis have of tendency of masking damage. If a ski is damaged during shipping, the flaw is likely to arise when the skier has placed the ski in a high stress position, placing both life and limb in peril. Damage may arise from any situation where the skis are subject to adverse handling, leaving the fabric cover suitable only for shielding the skis from moisture.

The main problem with hard covers is their inability to be stored or accommodate a range of ski lengths. For example, a 220 cm downhill ski will not fit in a cover designed for 160 cm freestyle ski. Even a 5 cm difference in ski length versus ski cover may render the hard cover useless. Placement of a shorter ski within a larger cover presents a volume of space that may allow the skis to slide internally and the increased size leads to additional problems in storage.

Another problem with the prior art is a result of the skis' use in frigid temperatures while ski storage is typically indoors. The problem arises in the expansion and contraction of dissimilar materials utilized in construction of a ski i.e. metal screws to hold the bindings to a composite ski. When the ski is taken indoors, the composite materials will warm up faster than the metal edging or binding attachment screws. The result is a high stress on the joining sections that may cause premature failure.

Thus what is needed in the art is a low cost soft foldable cover that provides impact resistance of a hard cover and a means to allow for a gradual warming or cooling of the ski equipment to prevent thermal shock. While the prior art sets forth various methodologies for covering skis, no prior is known that provides, either separately or in combination, the teaching, suggestion, or incentive to make a low cost ski guard that is an aesthetically pleasing functional cover that provides the functional impact protection of a hard cover, the flexibility of a soft fabric cover, and the ability to provide thermal shock protection.

SUMMARY OF THE INVENTION

The present invention is a ski guard that addresses the above problems through the use of a unique tubular foam material. The guard is constructed of high impact absorbing foam shaped into a seamless tubular housing with an elongated substantially flat end plug disposed in one end of the housing. The tubular housing conforms to the exact shape of the ski, with the resiliency of the foam providing necessary expansion for oversized skis providing a skin tight cover. A binding guard is also presented formed by placement of a sheet of foam within a fabric bag, the fabric bag having a means for fastening the binding guard about the ski bindings. The combination use of guards and ski straps allow the skis to be carried as a package in conjunction with a set of ski poles.

Installation of the ski guard is performed by sliding the modified housing over the tip of a ski until the tip resides against the inner surface of the end plug. If the housing abuts a binding, the housing can be slightly compressed or trimmed for a custom fit. A second housing is then placed over the tail of the ski drawing the housing to the edge of the binding. Similarly, a tip and tail housing is placed over the accompanying ski. When the skis are placed surface to surface, the binder cover can be placed over the bindings, the binding cover utilizing a zipper to enclose the cover longitudinally with an incorporated elastic band or tie string drawing the cover tightly about the skis.

Once installed the instant invention provides a skin tight guard that will absorb most impacts protecting the appearance of the skis and, more importantly, the integrity of the skiing surfaces. Placement of the guard over the ski directly after use provides a means for insulating the skis. If the skis are taken indoors, the skis will warm up slowly and uniformly as the tight covering provides an insulator to prevent radiant transfer of heat. In addition, the covering protects items that are impacted with the skis, such as car seats, furniture, and people. As with the covers of the prior art, the instant guard contains condensation from snow melting to prevent water damage.

Thus, it is an object of the invention to provide an inexpensive ski guard that is low in cost and provides the advantages of both a hard impact resistant cover and a soft fabric cover.

Still another object of the invention is to provide a guard that protects the ski against thermal shock.

Yet still another object of the invention is to provide a ski guard that can be made compact and easily stored in a relatively small space.

Still another object of the invention is to provide a universal ski guard that can be trimmed by the consumer to the exact length of a ski.

Another object of the invention is to provide a guard that is skin tight to the ski providing a cover that consumes minimal space and prevents conventional cover movement typically found when a fabric cover is used on an oversized hard cover.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION

Although the invention has been described in terms a specific embodiment, it will be readily apparent to those skilled in this art that various modifications, rearrangements and substitutions can be made without departing from the spirit of the invention. The scope of the invention is defined by the claims appended hereto.

Figure 1:
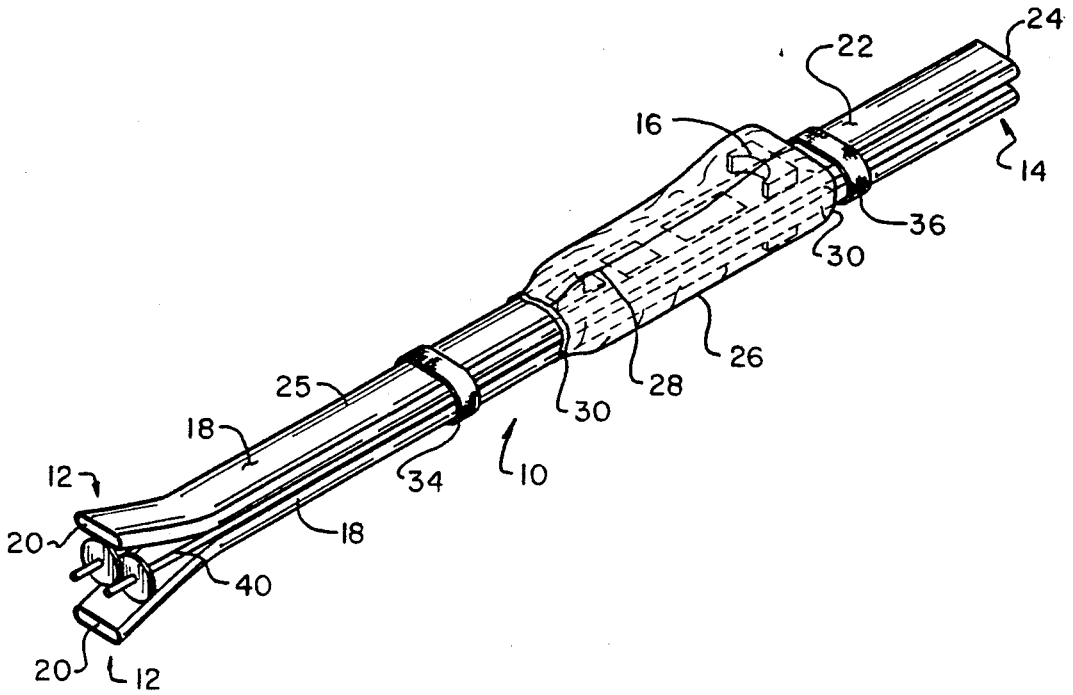
FIG. 1 is a perspective view of the invention installed upon a set of skis.

Now referring to FIG. 1, the present invention is shown in combination as a ski equipment package 10 shown in its conventional transport ready arrangement of back to back ski surface placement wherein each ski has a tip end 12 and a tail end 14 with boot bindings 16, disposed intermediate to the ends on the outboard side surface of each ski. The instant ski guard comprised of impact resistant compressible resilient foam material with a first tubular housing 18 having a side wall a width of $\frac{1}{4}''$ to $\frac{1}{2}''$ with a preferred thickness of $\frac{3}{8}''$. The first housing having a tip end plug 20 permanently attached to the housing 18 to enclose the ski tip when the housing is installed. A second flexible foam tubular housing 22, having a nominal wall thickness parallel to said first housing 16, also includes an end plug 24, not shown, permanently attached to the housing 22 to prevent the exposure of the ski end when the housing 22 is installed.

The first and second housings, 18 and 22 respectively, can be manufactured at the same length and trimmed by the consumer. However, the tip end of the ski is typically longer than the tail end making the preferred length of the tip end about 42" and the preferred length of the tail end about 30". The lengths still allow for custom trimming of the housings and provide a location 25 available for advertisement. Use of a different color for each portion of the ski cover has found popular appeal as well as means for designation of ski type or skier side preference.

A binding cover 26 is formed from a foam lined nylon bag attachable to said bindings by use of a zipper closure 28 disposed longitudinally along the length of the cover. Buckle closure straps 30 are placed at each end of the binding cover 26 allowing for a tight seal of the cover 26 to the ski package equipment.

Flexible strap means 34 and 36 are provided for placement adjacent to the end of the skis for wrapping the skis into a single bundle holding the assemblies together with the skis enclosed therein. The strap means secure the ski package together for easy manipulation further allowing the inclusion of a pair of ski poles 40 to reside beneath the first strap 34 and the binding cover 26.

Figure 2:
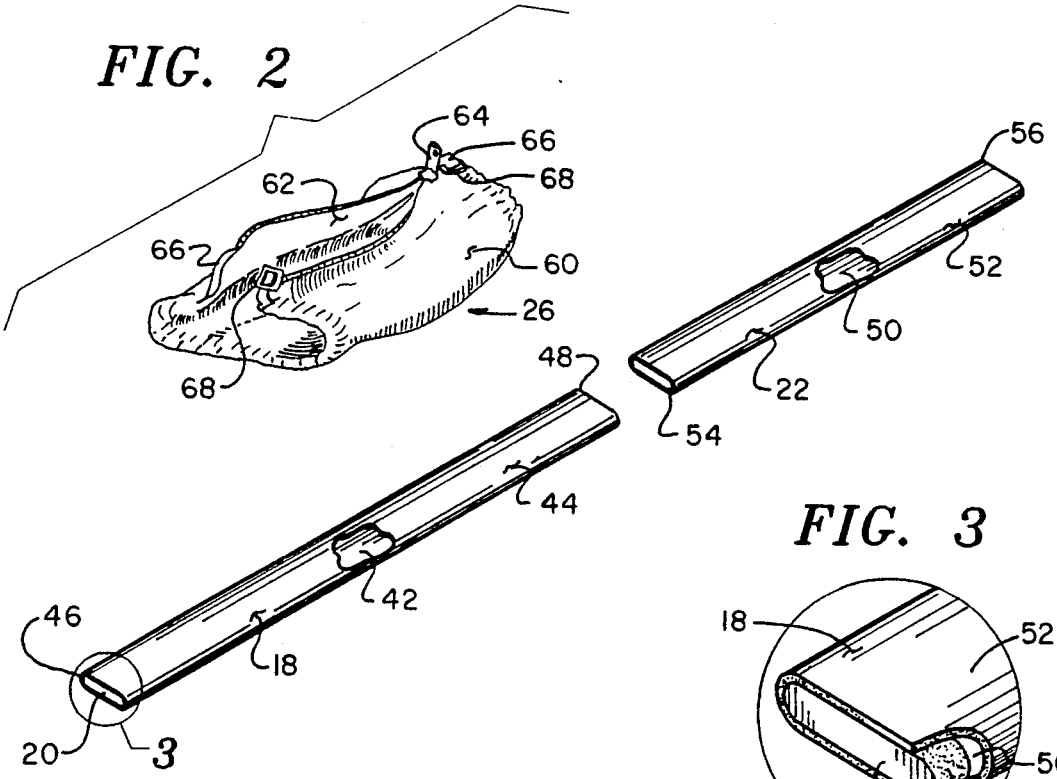
FIG. 2 is a component view illustrating the tip and tail portions, and the binder cover.

Now referring to FIG. 2, the tip end of the tubular housing 18 is shown formed by an inner surface 42 and an outer surface 44 defining an interior chamber with a first end 46 and a second end 48. The elongated end plug 20 enclosing one end of the interior chamber, the second end 48 available for trimming as previously described. The tail end of tubular housing 22 is shown formed by an inner surface 50 and an outer surface 52 defining an interior chamber with a first end 54 and a second end 56. The elongated end plug enclosing one end of the interior chamber, the first end 54 available for trimming as previously described.

The ski binding cover 26 has an outside layer 60 of nylon, or the like water resistant material having a foam 62 lined interior. A zipper 64 is disposed longitudinally along the length of the cover. To provide a tight seal, the use of a strap 66 and buckle 68 is provided wherein the strap 66 is insertable and interwoven through the buckle allowing a frictional engagement upon securement. The end plug 20 having dimensions of 3.5" long by $\frac{3}{4}''$ high by 1" thick with round corners to accommodate curvature of the housing.

Figure 3:
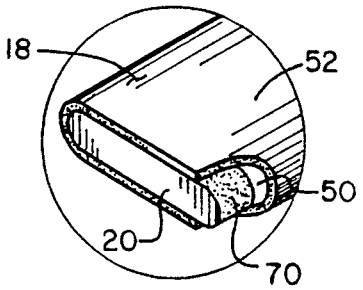
FIG. 3 is an cross-sectional view of the end plug typical of the tip and tail portions.

FIG. 3 illustrates a cross sectional view of the end plug 20 that is glued 70 to the housing 18 forming an impervious barrier to interior surface 50. The preferred end plug is $\frac{3}{4}''$ tall by 3.5" wide. The preferred width of the end plug is 1" thick which will prevent the tip of the ski from protruding through the end plug. Preferred wall thickness as defined by interior surface 50 and exterior surface 52 is $\frac{3}{8}''$ in width.

Installation of the skis into the ski housing is performed by placing the tip end of one said ski in to the interior chamber of housing 18 where the ski is slidably insertable until the ski tip abuts the inner surface 42 of the first housing end plug 20. The surfaces of the ski fictionally engagable with the interior chamber to maintain the housing in a fixed position. The tail end of the ski is then slidably insertable into the interior chamber 50 of the tail end housing 22 until the tail end abuts the inner surface of the second housing end plug 20. The surface of the ski fictionally engagable with the inner surface of the housing to maintain the housing 22 in a fixed position. The above steps are repeated for the second ski wherein the skis may face each other with the bindings placed outboard. The rear coupling strap 36 securely binds the tail of the skis in a fixed position. Ski poles 40 are placed on the outside edges of the ski tips with the ski handles placed next to the ski bindings. The front coupling strap 34 is placed around the tip end of the skis securely fastening the tips of the ski in a fixed position together with the ski poles. The binding cover 26 is then placed over the bindings and ski pole handles wherein the zipper places the binding cover in a tubular format. The skis are now fully enveloped within a foam cushion for transporting purposes. In addition, quick heating and/or cooling of the skis is buffered by the insulating foam to help prevent weakening of components due to thermal expansion.

It is to be understood that while I have illustrated and described certain forms of my invention, it is not to be limited to the specific forms or arrangement of parts herein describe and shown. It will be apparent to those skilled in the art that various changes may be made without departing from the scope of the invention and the invention is not to be considered limited to what is shown in the drawings and described in the specification.

What is claimed is:

1. A ski guard comprising: a conventional ski defined by two side surfaces having a tip end and a tail end with boot bindings disposed intermediate on one of said side surfaces; at least two generally flexible foam tubular housings, each of said housings having a side wall of nominal thickness formed by an inner surface and an outer surface defining an interior chamber with a first end and a second end; each of said housings further having a means for enclosing said first end, said means for enclosing being an end plug; whereby said tip end of said ski is slidably insertable and frictionally engagable into one said flexible housing abutting said means for enclosing, said tail end of said ski is slidably insertable and frictionally engagable into a second flexible housing abutting said means for enclosing, thereby guarding said side surfaces.

2. The ski guard according to claim 1 wherein said end plug is an elongated plug constructed of compressible foam insertable into the chamber of said housing.

3. The ski guard according to claim 2 wherein said foam end plug is 3.5" long by ¾" high by 1" thick.

4. The ski guard according to claim 2 wherein said end plug is permanently attached to said housing with a foam compatible epoxy.

5. The ski guard according to claim 1 wherein said foam material is ⅜" thick.

6. The ski guard according to claim 1, including a separate and independent building cover formed from a foam lined nylon bag attachable to said bindings.

7. The ski guard according to claim 6 wherein said binding cover includes a zipper closure means disposed longitudinally and a buckle closure strap placed at each end of said zipper closure.

8. A ski guard comprising: a conventional ski set by two skis each defined by two side surfaces having a tip end and a tail end with boot bindings disposed intermediate on one of said side surfaces; at least two generally flexible compressible foam tubular housings, each of said housings having a side wall of nominal thickness formed by an inner surface and an outer surface defining an interior chamber with a first end and a second end; each of said housings further having an elongated end plug insertable into the chamber of said housings; and a separate and independent binding cover formed from a foam lined nylon bag having a zipper closure means disposed longitudinally thereon with a means for sealing said nylon bag to said ski; whereby said tip end of one said ski is slidably insertable and frictionally engagable into a first one of said flexible housings abutting said first housing's end plug, said tail end of one said ski slidably insertable and frictionally engagable into a second flexible housing abutting said second housing's end plug, said tip end of a second ski is slidably insertable and frictionally engagable into a third one of said flexible housings abutting said third housing's end plug, said tail end of said second ski slidably insertable and frictionally engagable into a fourth flexible housing abutting said fourth housing's end plug, wherein juxtapositioning of each ski with outwardly extending binding allows enclosure of said bindings by said binding cover.

9. The ski guard according to claim 8 including a pair of coupling straps to hold said skis together in combination with a pair of ski poles.

10. The ski guard according to claim 8 wherein said housings include means for placing an advertisement thereon.

* * * * *